United States Patent [19]

Sobel

[11] Patent Number: 4,651,988

[45] Date of Patent: Mar. 24, 1987

[54] HAND HELD EXERCISE DEVICE

[76] Inventor: David D. Sobel, 15415 N. 22nd St., Phoenix, Ariz. 85022

[21] Appl. No.: 719,203

[22] Filed: Apr. 2, 1985

[51] Int. Cl.[4] ..... A63B 21/00

[52] U.S. Cl. ..... 272/143; 272/122; 294/27.1; 220/85 H

[58] Field of Search ..... 272/93, 143, 117, 122, 272/123, 128; 224/191, 269; 294/137, 140, 57, 26, 94, 31.2, 27.1; 220/85 CH, 85 H; 273/307, 26; 215/325

[56] References Cited

U.S. PATENT DOCUMENTS

| | | | |
|---|---|---|---|
| 524,230 | 8/1894 | Wesson | 294/26 |
| 2,308,244 | 1/1943 | Boys | 294/28 |
| 2,665,936 | 1/1954 | Moore | 294/145 X |
| 2,896,812 | 7/1959 | Paprocki | 220/85 H |
| 3,177,025 | 4/1965 | Short | 294/145 X |
| 3,412,866 | 11/1968 | Binding | 294/145 X |
| 3,542,236 | 11/1970 | Dru | 294/27.1 X |
| 3,979,011 | 9/1976 | Schleicher | 220/85 H X |
| 4,120,073 | 10/1978 | Studebaker | 294/27.1 X |
| 4,269,338 | 5/1981 | Sichel | 224/269 X |
| 4,345,756 | 8/1982 | Hoagland | 272/117 |
| 4,361,324 | 11/1982 | Baroi | 272/122 X |
| 4,456,135 | 6/1984 | Beekes | 220/85 H X |

*Primary Examiner*—Richard J. Apley
*Assistant Examiner*—Robert W. Bahr
*Attorney, Agent, or Firm*—Bauer & Amer

[57] ABSTRACT

A hand held exercise device capable of being detachably used as a handle with an empty container.

3 Claims, 4 Drawing Figures

HAND HELD EXERCISE DEVICE

BACKGROUND OF THE INVENTION

The present invention relates to an exercise device and in particular to hand-held weighted exercise device, and to a handle therefore and to a method of making the same.

Hand weights, such as bar bells, dumb-bells, and the like have been widely in use in gymnasium and homes to enhance physcial exercise programs for men and women of all ages. Recently, hand-held devices have become popular with joggers and walkers, as an auxilliary means for increasing the physcial exertion necessary, in particular, for upper body and heart muscle development. However, conventional bar bells, dumb bells, and the like are large and bulky devices that are heavy and ungainly to carry about when not in use. Because they are always in their weighted operative mode, they have no inoperative, unweighted condition or mode. Consequently, the transport of such devices create an unweildly encumberance, particularly before and at the end of an excerise, as a run or walk terminating remote from home or going or coming from the starting point of the excerise.

It is therefore an object of the present invention to provide a hand-held weight device which overcomes the foregoing disadvantages.

It is another object of the present invention to provide a hand-held weighted exercise device in which the bulk of the weight is contained in a disposable member which can be easily loaded with a selected amount of weight, attached to a weight exercise handle, and detachable therefrom and economicaly discarded at the end of the excercise.

It is a further object of the present invention to provide a hand-held weight device having a handle which is attachable to freely available, cheap and disposable containers of a type similar to but not limited to conventional beer or soda cans. As a result, the user need only own and retain the weight exercise handle when it is desired to use it for exercise, the user need only pickup any discarded can or container, which he can then fill to the desired weight thereby create and fashion for himself an exercising device. Such device is particularly suitable for joggers and/or walkers, who find a ready supply of discarded containers are available along the street, beach or running paths.

The foregoing objects and advantages as well as others will be apparant from the following disclosure of the present invention.

SUMMARY OF THE INVENTION

According to the present invention, the exercising device comprises a handle and an empty cylindrical container which are cooperatively formed to be snap-fastened to each other. The container may be, for example, an ordinary container or can of the type commonly used for beer or soda, empty or discarded, used or unused, the weight of which may be predeterminately varied by selectively filling the container with sand, pebbles, or other weight material found along the excerise route. Generally, the container is a cylinder closed at its bottom end although it may be of any other shape.

The handle is formed with a head adapted to attach to, as to seat on the top of the container. It has a foot engageable with the bottom of the container, and a connecting arm which cooperates with the head and foot to maintain a resilient bias securing the container therebetween. Preferably, the foot is provided with a detent or groove fitting about and over the peripheral rounded edge of the can or container bottom.

The head of the handle is preferably formed with engaging means in the form of a recess which fits and over about the top of the can and seals the periphery of the top against loss of its contents. Preferably, a depending boss is formed in the face of the recess which is capable of entering and projecting into the hole of a conventional pull-tab closure can, sealing the hole and simultaneously preventing rotation of the can and/or lateral shifting of the same relative to the handle.

Full details of the invention are set forth in the following disclosure, and are illustrated in the accompanying drawing.

BRIEF DESCRIPTION OF THE INVENTION

DESCRIPTION OF THE INVENTION

Figure 1:
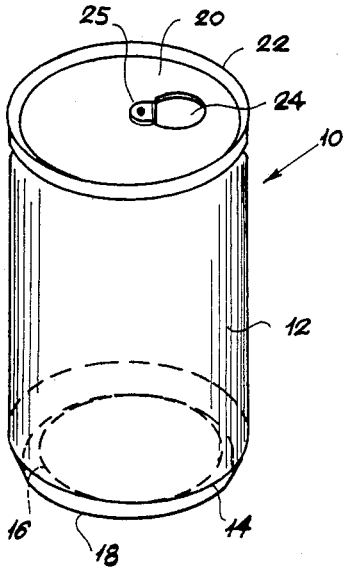
FIG. 1 is perspective view of a container or can that may be used in the present invention.

Turning now to FIG. 1, the container that may be in the form of a conventional can is generally depicted by the numeral 10. The can 10 is shown to have a cylindrical body 12, unitarily formed with a bottom 14, which is provided with a slightly inwardly recessed central portion 16 being defined by a rounded marginal lip 18. A cover 20 is integrally secured by means of appropriate beading 22 to the body 12, and is provided with a hole 24 which in the original manufacture of the can, was sealed by a removable pull-tab (not shown) riveted at 25 to the top cover 10. In certain conventional cans, the lip 18 is sometimes omitted or not prominent. In its place, the can is sometimes provided with another form of lip, such as a ridge or boss, which like the lip is normally used to center or orient the can during automatic filling and labeling with its contents.

Should a customized container be desired, it is preferable for the reasons to be set forth hereinafter, that the cylindrical body and bottom shape be retained with the marginal lip or other detent means. The integral cover may be replaced with a removable cover, such as a threaded cap, and the hole 24 dispensed with altogether.

Figure 2:
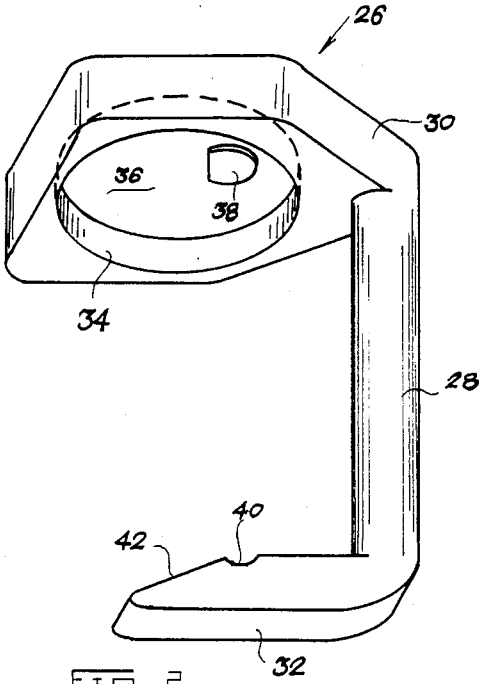
FIG. 2 is a perspective view of the handle of the present invention.

As seen in FIG. 2, the handle is generally depicted by the numeral 26 and comprises an arm 28 which may be conveniently contoured to form a comfortable hand grip. The arm 28 has a length slightly shorter than that of the body 12 of the container and has secured at one end engaging head means 30 and at its other end foot engaging means 32 each extending generally in the same radial direction. Preferably the handle 26 is made of high density plastic material, so that the head 30, foot 32 and arm 28 are unitarily formed. The arm 28 connects the head and foot together in relative spaced relationship so that there is degree of yield and resiliency or springness is provided between the head and the foot to permit them to move relative toward and away from each other. Such structure and resilient flexing movement is also possible when metal materials such as aluminum are employed and the arm 28 integrally secures together separately formed head 30 and foot 32, as should be obvious.

Returning to FIG. 2, the head 30 is in the form of a body large enough to accommodate the covered end of the container 10. To this end it has a recess 34 formed in its lower face. The recess 34 is cylindrical to conform in shape and circumference to that of the cylindrical can 12 (specifically the bead 22, if the same is provided) so that a snug or even a force fit can be made on insertion of the top of the can 10 into the recess 34. The inner face 36 of the recess is provided with a projecting boss 38 preferably in the shape and size of the hole 24 left in the top of the container 10 after the closure tab is removed so that it can fit closely within the hole 24. The boss 38 serves to close the hole 24 and also serves as an indexing stop, once inserted therein to prevent the container from rotating about its cylindrical axis. In the absence of a hole 24 in the can, the boss 38 will press against the top of the container, enhancing the tight connections of the container 10 with the handle.

Although the recess 34 has been described as cylindrical in shape, the same should not be considered a limitation upon the scope of the invention. It has been so described only to make it clear, the same conforms in shape and size to the container 10. Thus, if other shaped containers are to be used the recess 34 will be correspondingly contoured and sized.

The foot 32 is formed with a detent groove 40, adapted to receive engage and detain the annular lip 18 or other detent means of the container 10. The forward edge 42 of the foot 32 is bevelled with a curved cam-like surface over which the lip 18 or container detent means will ride to spread apart and yieldingly distend or move the foot 32 and head 30 relative away from each other to permit the lip 18 to enter into the detent groove 40, as seen from the dotted lines in FIG. 3. Once the lip 18 is accommodated within the groove 40, as seem in FIG. 4, the head 30 and foot 32 spring back to their normal spaced relationship by reason of their interconnecting arm 28.

In practice, the handle 26 may be carried about easily. Its light weight and relatively small size makes it conveniently portable. If desired, it may even be used as a convenient carrier for a yet unused container filled with water, tea, soda, beer and the like. It may also be carried empty and free of carrying support of any container at all. Regardless of how it is held it is readily converted to an excerise device. All that is necessary to convert it to an excerise is to choose a container.

Figure 3:
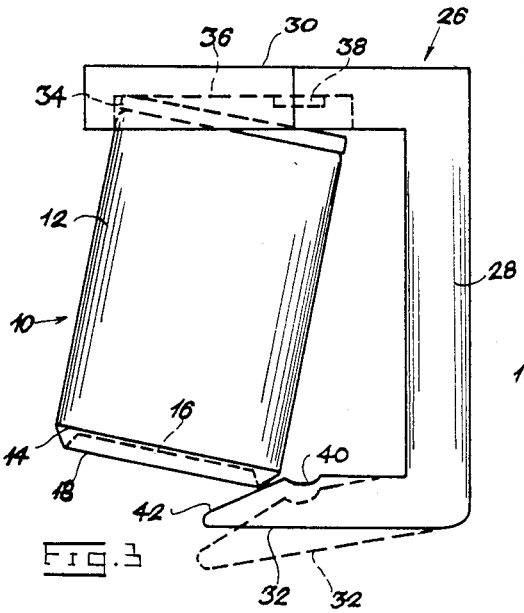
FIG. 3 is a side view of container and handle in the process of assembly or disassembly, as the case may be.
Figure 4:
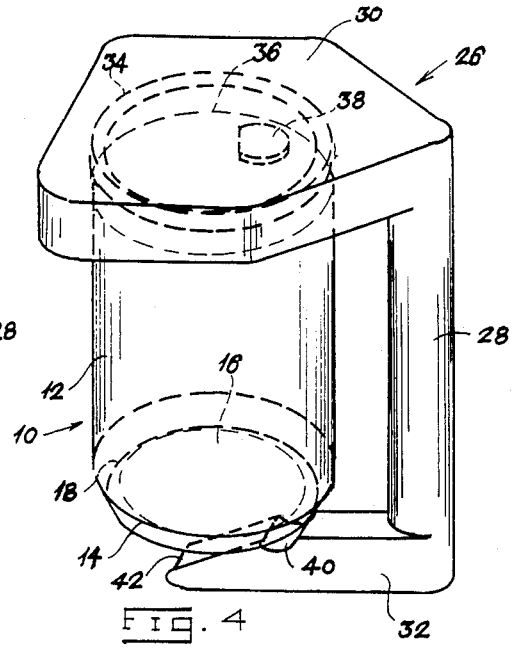
FIG. 4 is a perspective view of the handle and container fully assembled.

The container may be one previously mounted or attached to the handle 26 or one that is found discarded along the excerise path or route. The chosen container 10 is first filled with weight material, such as sand, pebbles, marbles, metal pieces or any other weight material. The weight of course, is easily controlled by the user who can fill the container partially or fully as desired and who can use light and heavy material in combination. Once the can is filled or loaded to the desired weight, the top of the ccan is inserted into the confines of the recess 34 of the head 30, tilted slightly as seen in FIG. 3.

The can bottom 18 pushed against and along the bevelled or curved end 42 of the foot 32 causing it to yield until the lip 18 slides in the groove 40. Once so seated and detained between the foot 32 and head 30, by their resilient bias toward each other the can will be held firmly in place. If the boss 38 does not initially seat within the hole 24, the containeer may be rotated until the boss 38 seats in the hole 24. The container is locked from relative rotation and cannot then be accidentally dislodged. The combined handle 26 and weighted container 10 can be used as an exercise device without fear that the container will dislodge from the handle.

It is noted that the present invention may be readily used with any of the commonly available beer or soda can, that may be selectively loaded with any material to any desired weight. Such cans are frequently found discarded, along roadsides, playgrounds, beaches, and other areas where the specific exercise is to take place. Such discarded cans are usually empty, and have an opening into which the desired weight may be inserted, and which can then be closed against loss by the boss 38. An important advantage lies in the fact that such cans are free, need not be purchased in advance, need not be transported to the exercise site, and after exercise, can be disposed of, leaving the user free of any unwieldy, weighty encumberance.

Various modifications and changes have been suggested, however, and others will be obvious to those skilled in the art. Therefore, it is intended that the foregoing description be taken as illustrative and not as limiting of the scope of the invention.

What is claimed is:

1. Apparatus for converting can for beer, soda, or the like having an eccentric opening on its top end and a peripheral lip on its bottom end, into an operative weighted exercise device, comprising a handle for the can having an opposed head and foot connected by an arm, said head comprising a rigid plate adapted to extend over the top end of the can and having a recess conforming to the shape of the can to receive the top end of the can, said recess engagingly covering said top end of the can to enclose the same from damage and having means depending therefrom into the opening of the can to close the same and prevent relative rotation of said can and handle when said handle is secured to the can, said foot having a groove for engaging the peripheral lip on the bottom end of the can, said arm maintaining said head and foot resiliently biased toward each other to secure the can under pressure between said head and said foot against accidental dislodgement from said handle and permitting said head and foot to flex relative to each other to enable the can to be manually inserted into engagement between the same and to be manually disengaged therefrom.

2. A hand-held exercise device comprising, in combination, a container such as a can for beer, or soda adapted to receive material to increase its weight and a detachable handle; said container comprising a cylindrical body having a top and a bottom, said top being formed with a wall having an eccentric opening into which weight material is inserted, and said bottom being formed with detent means extending axially outwardly therefrom; said detachable handle comprising a head, a foot and a connecting arm, said head comprising a rigid plate extending over the top of said container having a recess sufficiently large to allow the top of said can to seat therein, and a depending boss fitting within and closing the eccentric opening in the top of said container to prevent the loss of weight material from said container and to prevent rotation of said container relative to said head, said foot extending beneath said container and having means for receiving said detent means at the bottom of said container, said arm connecting said head and said foot under spring tension to normally secure said container between said head and said foot against accidental dislodgement and to permit said head and foot to flex relative to each other to enable said container to be attached to and detached from said handle in response to manual movement of said container between said head and foot.

3. The apparatus according to claim 2, wherein said detent means comprises an annular lip about the peripheral edge of the bottom of said can, and said receiving means on said foot.

* * * * *